US005368061A

United States Patent [19]

Mollo

[11] Patent Number: 5,368,061

[45] Date of Patent: Nov. 29, 1994

[54] LOAD SENSED VARIABLE DISCHARGE FIXED DISPLACEMENT PUMP CONTROL WITH LOW UNLOAD FEATURES

[76] Inventor: James R. Mollo, 209 Julrich Ave., McMurray, Pa. 15317

[21] Appl. No.: 121,275

[22] Filed: Sep. 13, 1993

Related U.S. Application Data

[63] Continuation-in-part of Ser. No. 784,388, Oct. 29, 1991, Pat. No. 5,244,358, which is a continuation-in-part of Ser. No. 426,750, Oct. 24, 1989, abandoned, which is a continuation-in-part of Ser. No. 211,163, Jun. 22, 1988, abandoned, which is a continuation-in-part of Ser. No. 8,313, Jan. 29, 1987, abandoned.

[51] Int. Cl.[5] ..... F15B 13/02

[52] U.S. Cl. ..... 137/115; 91/451; 137/596.13; 137/599.2

[58] Field of Search ..... 91/451; 137/115, 596.13, 137/599.2

[56] References Cited

U.S. PATENT DOCUMENTS

| | | | |
|---|---|---|---|
| 2,305,519 | 12/1942 | Dunmire | 137/115 X |
| 3,379,133 | 4/1968 | McCormick . | |
| 3,718,159 | 2/1973 | Tennis | 137/596.13 X |
| 3,722,543 | 3/1973 | Tennis | 137/596.13 X |
| 3,828,813 | 8/1974 | Haussler | 137/596.13 |
| 4,040,438 | 8/1977 | Wilke | 137/596.13 |
| 4,122,865 | 10/1978 | Budzich | 137/596.13 |
| 4,520,902 | 6/1985 | Snow | 184/7.4 |
| 4,798,126 | 1/1989 | Budzich | 137/596.13 X |
| 5,048,396 | 9/1991 | Torkler et al. | 137/596.13 X |
| 5,244,358 | 9/1993 | Mollo | 137/596.13 X |

*Primary Examiner*—Gerald A. Michalsky

*Attorney, Agent, or Firm*—Webb Ziesenheim Bruening Logsdon Orkin & Hanson

[57] ABSTRACT

A load sensed variable output gear pump having adjustable high pressure compensation, tuneable response, low unloading pressure and variable pressure drop adjustability. It comprises a unitary housing enclosing a pump which pumps through a main inlet-outlet passage which bypasses through a combined control having a single load sense line. The single control including a chamber connected to the load line by means of a popper with a 2:1 area ratio and a spool having a 1:1 area ratio. An overload control may also be used connected to an inlet load sensing passage which tends to close said fixed and variable controls.

3 Claims, 5 Drawing Sheets

PRESSURE AFFECTED AREAS
A AND B = LOAD PRESSURE ONLY
C AND D = PUMP DISCHARGE PRESSURE ONLY

AREA RATIOS
A + B TO C + D = 2 TO 1
B TO C = 1 TO 1

LOGIC CHART

| PUMP FUNCTION | AREA AFFECTED | | | | SPOOL OR POPPET ACTION | |
|---|---|---|---|---|---|---|
| | A | B | C | D | SPOOL 32 | POPPET 1 |
| LOW UNLOAD | Z | Z | P | P | C | O |
| PARTIAL OUTPUT FLOW | L | L | P | P | M | C |
| FULL OUTPUT FLOW | L | L | P | P | C | C |
| RELIEF AT LOAD | L | L | P | P | M | C |
| LOAD SENSE DUMP | Z | Z | P | P | C | O |

KEY
Z = ZERO PRESSURE
L = LOAD PRESSURE
P = PUMP DISCHARGE PRESSURE
C = CLOSED OR OFF
O = OPEN OR ON
M = ON AND MODULATING

FIG. 5A

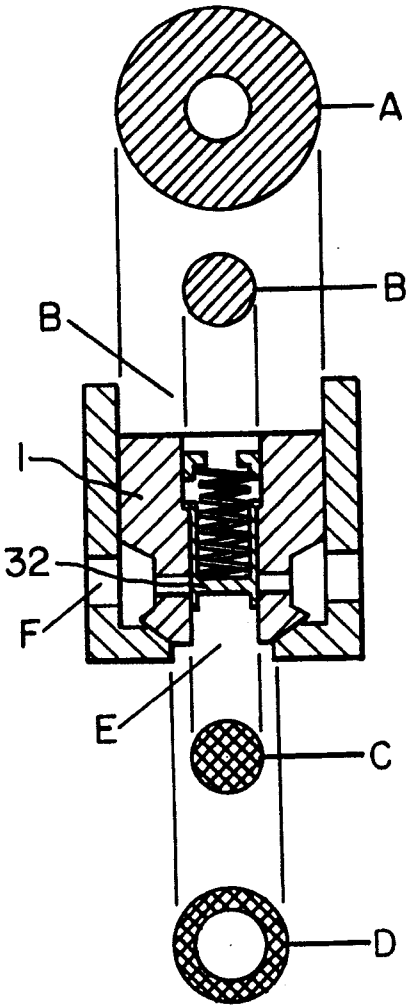

FIG. 5

LOAD SENSED VARIABLE DISCHARGE FIXED DISPLACEMENT PUMP CONTROL WITH LOW UNLOAD FEATURES

RELATED APPLICATIONS

This application is a continuation-in-part of copending application Ser. No. 07/784,388 filed Oct. 29, 1991, now U.S. Pat. No. 5,244,358, which is a continuation-in-part of application Ser. No. 07/426,750, filed Oct. 24, 1989, now abandoned which is a continuation-in-part of application Ser. No. 07/211,163, filed Jun. 22, 1988, now abandoned which is a continuation-in-part of application Ser. No. 07/008,313, filed Jan. 29, 1987.

BACKGROUND OF THE INVENTION

This invention relates to controlling bypass flow of a fixed displacement pump internally in response to external load and flow requirements in a load responsive system.

A more particular aspect of the invention is the internal pump control, of pump discharge pressure to low unload pressure near atmosphere, in the standby load responsive condition via a single signal from said load responsive system.

Load sensed directional control valves with load sensing bypass flow controls have greatly reduced the system input horsepower requirements in systems using fixed displacement pump. A typical type of this direction control valve with bypass can be seen in the United States patent issued to Haussler U. S. Pat. No. 3,488,953 and U.S. Pat. Nos. 3,882,896 and 4,159,724 issued to Budzich. Although these valves have greatly increased the system efficiency these types of valves do dictate a load sensed pressure equal to the delta P of the bypass flow control in the neutral or standby condition. This pressure can exceed a value of 200 psi and depending on the discharge volume of the pump represent a high energy loss in the standby mode. This type of valve, due to the nature of it being a directional type control valve, is usually physically installed in a system a great distance from the fixed displacement pump and near the actual load. This situation causes the pressure drop to vary by the length of line or pressure conduit and number of restrictions due to fittings and pipe bends between the fixed displacement pump and the valve. This pressure drop depending on the good wishes of the user can amount to a pressure greater than 200 psi. The doubling of the previously mentioned 200 psi across the valve bypass control relates to a 400 psi pump pressure drop and although the standby drop constitutes a significant loss in efficiency within this type of valve, it is doubled when added to the line loss seen in the interconnecting lines from the fixed displacement pump to the valve.

My patent application Ser. No. 07/008,313, filed Jan. 29, 1987, now abandoned, shows the integration of two controls internal within the fixed displacement pump accomplishing the low unload standby and load sensing bypass control and resulting in a minimum savings in horsepower of 50% using a single load responsive signal. The Budzich U.S. Pat. No. 4,789,126, filed Mar. 23, 1987 and issued Jan. 17, 1989, shows a low unload load responsive pump control. However, the said line losses and the requirement of an auxiliary pump to function the low unload causes a minimal increase of efficiency in reference to Haussler. Although my earlier patent application reduced horsepower draw by over 50% in reference to the Haussler or Budzich patents, the dual controls for bypass and low unload contained internally within the fixed displacement pump and where connected to the pump discharge volute passage in a parallel teed drilling resulting in a flow path incorporating a 90 degree flow path alteration. This change in fluid flow direction resulted in a fractional horsepower draw.

SUMMARY OF THE INVENTION

It is therefore the object of this invention to combine the low unload control and bypass control seen in my patent application Ser. No. 07/008,313, now abandoned, into a single unit internally installed directly to the discharge gear volute and in series with the flow path causing said control to be part of the discharge volute structure, further reducing any possible pressure drop across the single control to tank. It is not an objective to create a valve that could be mounted remote from a pump, or in any way be connected to a fixed displacement type pump, although this design would lead to uses not encompassed within the embodiment of this patent enhancement it should be noted that these rights be reserved under the parent application. It is only an object of this application and for enhancement that the combined control exceeds the previously applied for patent as solely a pump control mounted within the casting and being an integral part of that pump.

It is another object of the invention to reduce the pump casting in reference to required material and intricate coring and extra machining time by the use of the combined control.

It is also another object of the invention through the use of the combined control to create a single load sense line responsive pump that only functions as a bypass load responsive pump with low unload features via a single passage to tank. As opposed to my earlier design that used two controls and allowing the passage to tank the capability of independent action via a second tank passage creating the possibility of low unload and bypass to a secondary system function.

It is also another object of the invention to speed up the pump response time in reference to low unload and load functions by incorporating a single combined bypass low unload control.

It is also another object of the invention to encompass all previous objectives of the patent application Ser. No. 07/008,313, now abandoned, with the addition of the previously stated enhancement of a combined control encompassing low unload and bypass flow control in reference to a single load sense signal taken from a load responsive valve or a plurality of said load sense valves.

BRIEF DESCRIPTION OF THE DRAWINGS

FIG. 5 shows a longitudinal view of the combined low unload bypass control with effective areas;

FIG. 5A is a logic chart for the combined control function shown in FIG. 5; and

DESCRIPTION OF THE PREFERRED EMBODIMENTS

Figure 2:
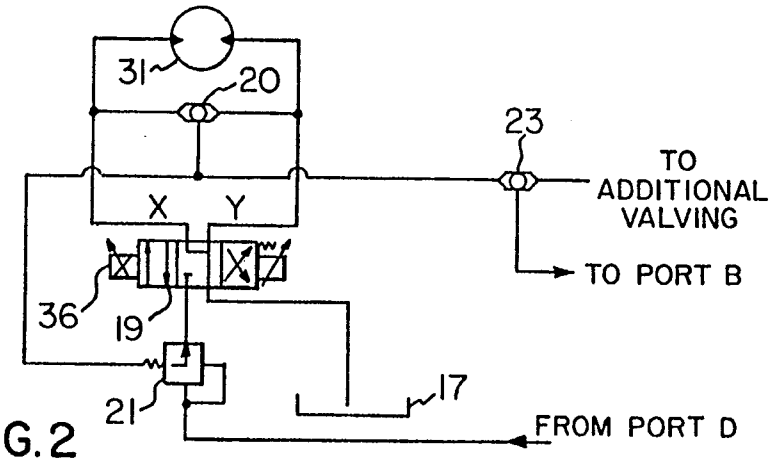
FIG. 2 shows a schematic representation of a load responsive system and uses a symbol of a motor to represent load.

FIG. 2 shows a schematic representation of a load responsive system which, per se, forms no part of the present invention. The hydraulic motor 31 is the output device when connected to a load, its speed and torque delivered to said load is a function of fluid flow (motor speed) and fluid pressure (motor output torque). The combination of the load sensing shuttle 20, the proportional direction control valve 19 and the inlet hydrostat of the non-bypass style 21 embody a typical load responsive valve system as can be seen in the Haussler patent previously mentioned. The inlet in line hydrostat 21 which is well-known in the state of the art as a device containing a spool, poppet or plunger that is designed with identically sized end faces that when subjected to pressure cause the device to be hydrostatically balanced, uses the pressure drop across the metering spool contained in valve 19 to cause a constant fluid flow regardless of upstream pressure fluctuations when a plurality of control valves are simultaneously in use. This condition is known as pressure compensation. Additional valves may be added as long as they are in parallel in reference to the valve inlet pressure port and are shuttled together in reference to load via shuttles 23. The load responsive system transmits only the highest load pressure registered to the hydraulic pump which must be a variable discharge type pump. Said pressure signal due to the center configuration of valve 19 or the plurality of valves 19 is either ON to load or OFF to zero pressure, i.e., tank 17. The bypass style hydrostat which is well-known in the state of the art as a parallel hydrostat as opposed to the said in-line or series type hydrostat cannot be used with a variable output or discharge type of pump.

Figure 1:
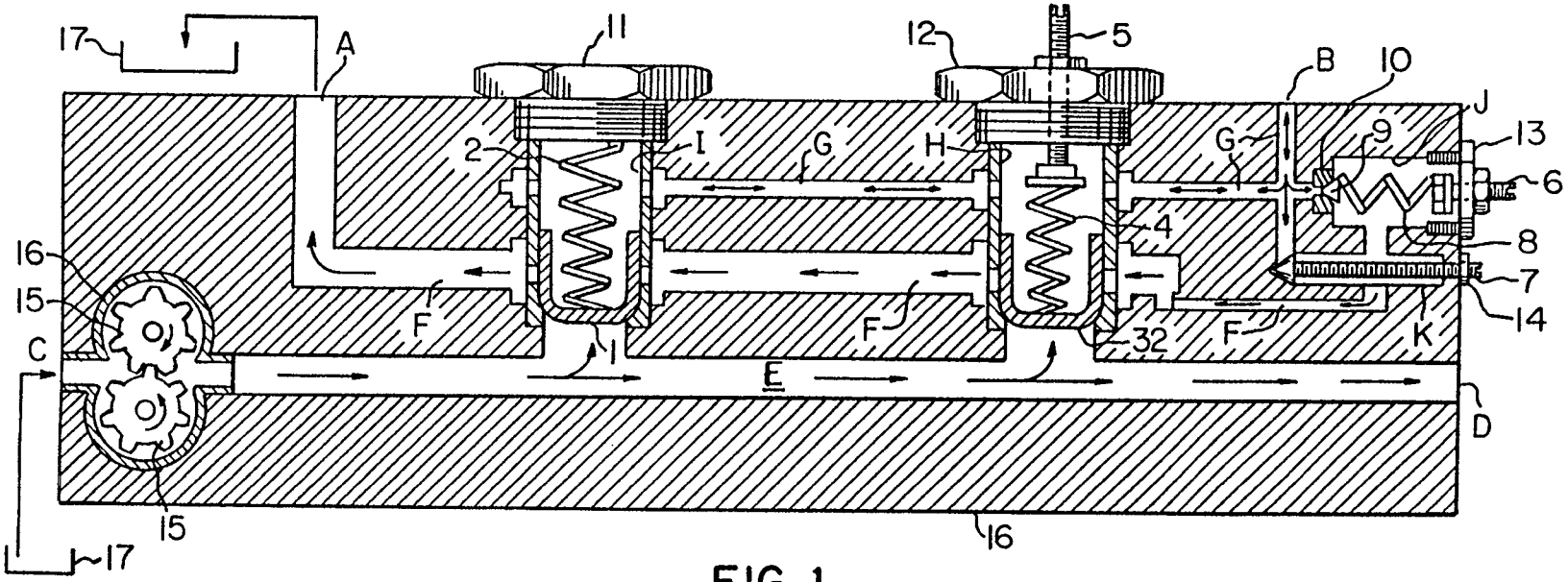
FIG. 1 shows a longitudinal section view of the Load Sensed Variable Output Gear Pump of my application Ser. No. 07/008,313, now abandoned.

Referring now to FIG. 1, a Variable Output or Discharge Gear Pump of the Load Sense type is shown, having a low unload control 11, the high pressure relief or system compensator control 13, the response tuning adjustable orifice 14 and the bypass control or adjustable parallel hydrostat 12.

Control 11 has a 2:1 effective and pressure sensitive area ratio in reference to chamber I and chamber E regarding the movement of poppet 1, and the adjustable hydrostat 12 noted as a hydrostat and having an identical pressure sensitive area in reference to chamber H and chamber E causing poppet 32 to react in reference to the load responsive signal delivered through port B to passage G, are in parallel through their connection to passage E. This plurality of controls causes an additive pressure drop that can be diminished by combining said control 11 and control 12 into a single controller eliminating the passage pressure drops seen on the plurality of these two controls in parallel and speeding up the overall pump response time.

The pump in FIG. 1 operates as follows: In the neutral condition, the control valve or valves 19 will be in a P pressure blocked with X and Y to reservoir 17, spring center condition. This neutral condition of the pump 16 is shown in FIG. 1 and neutral condition of valve 19 is schematically represented in FIG. 2. As the gears 15 are turned, hydraulic fluid is directly pulled from the reservoir 17, through port C. The fluid is discharged from gears 15, to passage E and out-port D and through the inlet in-line hydrostat 21 to the pressure blocked port on valve 19, thus deadheading the pressure line. Spring 2, in control 11, will begin to be depressed by the pressure exerted against the area of poppet 1, in reference to passage E. At a low pressure 30 psi or less in passage E, poppet 1 will move enough to connect passage E to passage F through control 11, allowing the fluid to pass out port A to the reservoir 17. Fluid at this time cannot pass from passage E to F through control 12 as the spring 4, tension is adjustable in a range of 60 to 300 psi and holding poppet 32 in the closed position. At this time all flow produced by the turning of the gears 15 is passing through control 11 to the reservoir 17 at a low pressure drop. As no fluid flow is present past the pressure blocked port in the control valve 19, the pump load sense port B, feels only reservoir pressure in passages G, and in turn chamber H of control 12, and chamber I of control 11. Poppet 1 in control 11 has a 2:1 pressure effective area ratio in regard to chamber I and passage E. The unbalanced areas allow spring 2 to be of a light rate.

This means that the effective area on which pressure can be applied to poppet 1, in said control 11, via passage E, is 50% less than the effective area which pressure can be applied to poppet 1, in said control 11, via chamber I. If the pressure in chamber I is reservoir pressure or ZERO, the amount of pressure in passage E required to open passage E to passage F would be equal to the pressure exerted on the area of poppet 1 in said control 11 via the pressure in passage E exceeding the amount of pressure exerted on the poppet 1 in said control 11 via spring 2.

Referring to FIG. 2, wherein standard parts are illustrated schematically, and which assembly, per se, forms no part of the present invention, valve 19 is a proportional control valve which is pressure compensated by valve 21. Valve 20 is a shuttle valve giving an alternative signal in relation to load activation as an output signal from the load or actuator to the controller or, in this case, the pump 16. As power is applied to the solenoid 36, valve H is shifted to the right, allowing flow passage P to flow over the compensator valve 21 through valve 19, and to the motor 31. The amount of load is transmitted through the shuttle valve 20 to shuttle valve 23. Shuttled valve 23 transmits the load pressure to the pump 16, entering port B. Port B transmits the pressure through passage G to chamber H in control 12, chamber I in control 11, to control 14 screw 7, and control 13 poppet 9. As soon as any positive pressure is exerted on chamber I, control 11 closes, stopping flow from passage E to passage F across control 11. This means that when said control 11 has the same or greater pressure exerted on chamber I in reference to the pressure exerted in passage E, said control 11 goes to the closed position. This occurs because of the aforementioned area ratio difference that requires two times the force in regard to the pressure in passage E as opposed to the pressure in chamber I. As control 11 closes, control 12 begins to open passage E to the passage F modulating the flow and bypassing only enough fluid to maintain a prescribed pressure drop. As control 11 closes, the pressure in passage E and chamber I continues to increase, causing control 12 to begin to open due to the bias set on said control. This pressure drop is variable for multivalve use and is regulated via screw 5 which controls the set tension on spring 4 in control 12.

Only said control 11 maintains a 2:1 area ratio in reference to passage E and chamber I as aforementioned. Control 12 is spring-biased and has an effective area ratio of 1:1 in reference to passage E and chamber H, causing said control 12 to be the only truly biased control. As passage G senses load pressure and this pressure is applied to chamber H of control 12, the total pressure in passage E would be spring tension plus load pressure.

If the pump output flow, due to downstream restrictions in the piping or the control valve assembly 9, is not sufficient, the spring tension can be increased by adjusting screw 5 on control 12. Pressure would increase with load until the setting on control 13 was reached. At a predetermined and adjustable pressure, poppet 9 would lift off seat 10 allowing flow from passage G to chamber J. The high pressure is set by screw 6 changing the tension on spring 8 in control 3. This offsets the balance pressure in chamber H allowing more flow to passage F from passage E keeping the pressure from exceeding the preset valve in control 3. If the controlled response is too fast, control 14 can be adjusted by turning screw 7, causing a control response lag via controlled leakage form passage G to passage K which is interconnected to passage F and the reservoir 17.

When valve 19 returns to the neutral condition, the pump 16 returns to the first mentioned condition.

Figure 3:
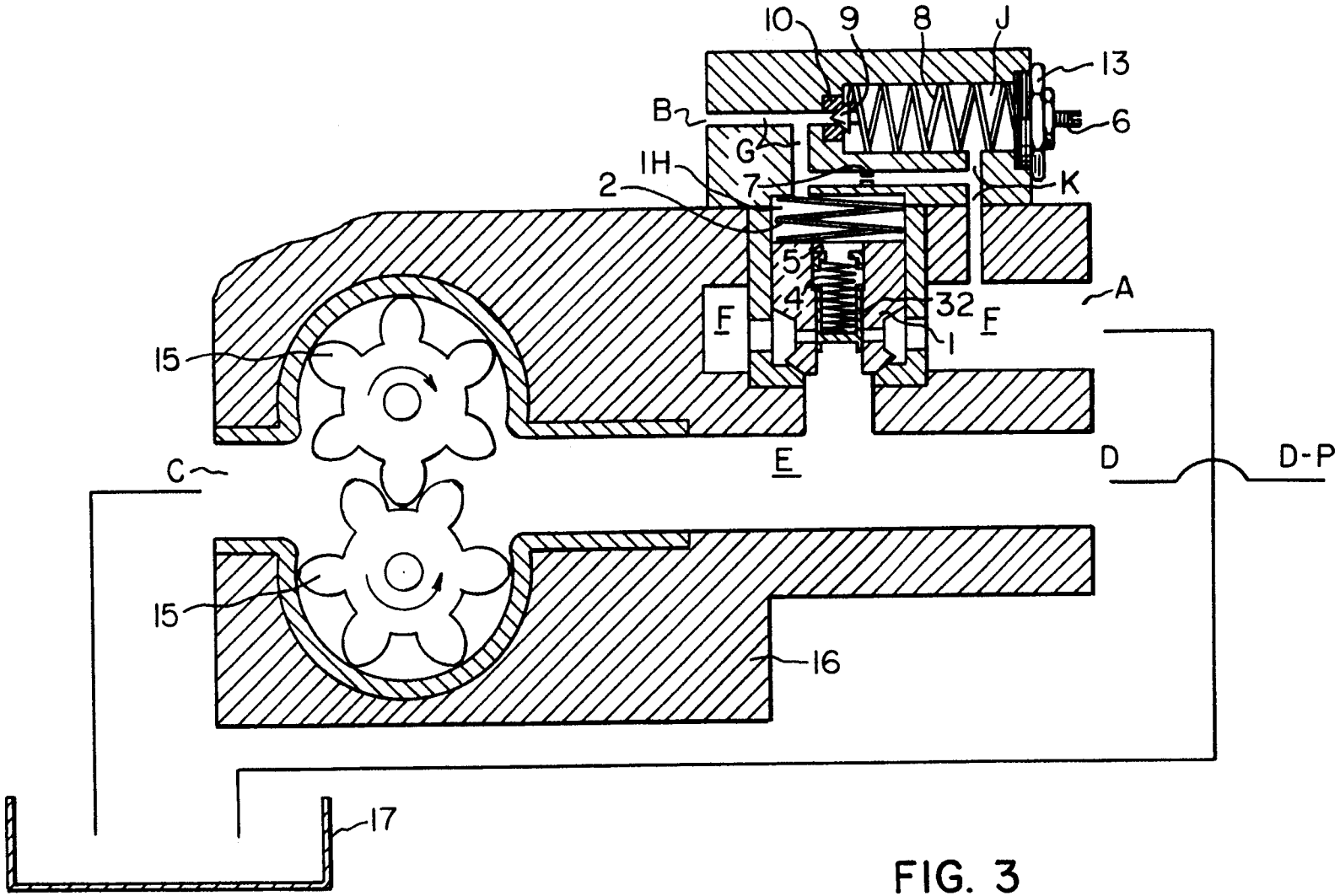
FIG. 3 shows a longitudinal section representation of the combined low unload bypass control with a hydrostat of the spool design.

FIG. 3 shows a representation of the improvement of this application which combines control 11 and control 12 of FIG. 1 into the configuration of chamber IH, spring 2, adjustment 5, spool 32, spring 4 and poppet 1 which is a unique design accomplishing the previously mentioned actions of controls 11 and 12 in a single unit control. The combination control shown in FIG. 3 has been rotated counterclockwise 90 degrees for the purpose of explanation only and can be seen in FIG. 5 in an actual placement in reference to the pump discharge volute.

The pump in FIG. 3 operates as follows: In the neutral condition, the control valve or valves 19, FIG. 2, will be P pressure blocked with X and Y to reservoir 17, spring center condition. This neutral condition of the pump 16 is shown in FIG. 3 and neutral condition of valve 19 is schematically represented in FIG. 2.

As the gears 15 are turned, hydraulic fluid is directly pulled from the reservoir 17, through port C. The fluid is discharged from gears 15, to passage E and out-port D and through the inlet in-line hydrostat 21 to the pressure blocked port on valve 19, thus deadheading the pressure line. Spring 2, in the combined control will begin to be depressed by the pressure exerted against the area of poppet 1, in reference to passage E. At a low pressure 30 psi or less in passage E, poppet 1 will move enough to connect passage E to passage F the combined control, allowing the fluid to pass out port A to the reservoir 17. Fluid at this time cannot pass from passage E to F through the combined control spool 32 as the spring 4, tension is adjustable in a range of 60 to 300 psi and holding spool 32 in the closed position. At this time all flow produced by the turning of the gears 15 is passing through the combined control to the reservoir 17 at a low pressure drop. As no fluid flow is present past the pressure blocked port in the control valve 19, the pump load sense port B, feels only reservoir pressure in passages G, and in turn chamber IH of the combined control. Poppet 1 in the combined control has a 2:1 pressure effective area ratio in regard to chamber IH and passage E. The unbalanced areas allow spring 2 to be of a light rate and be removed if a near atmosphere unload condition is required. This means that the effective area on which pressure can be applied to poppet 1, in said combined control, via passage E, is 50% less than the effective area which pressure can be applied to poppet 1, in said combined control, via chamber IH. If the pressure in chamber IH is reservoir pressure or ZERO, the amount of pressure in passage E required to open passage E to passage F would be equal to the pressure exerted on the area of poppet 1 in said combined control via the pressure in passage E exceeding the amount of pressure exerted on the poppet 1 in said combined control via spring 2.

Referring to FIG. 2, wherein standard parts are illustrated schematically, and which assembly, per se, forms no part of the present invention, valve 19 is a proportional control valve which is pressure compensated by valve 21. Valve 20 is a shuttle valve giving an alternative signal in relation to load activation as an output signal from the load or actuator to the controller or, in this case, the pump 16.

As power is applied to the solenoid 36, valve H is shifted to the right, allowing flow passage P to flow over the compensator valve 21 through valve 19, and to the motor 31. The amount of load is transmitted through the shuttle valve 20 to shuttle valve 23. Shuttle valve 23 transmits the load pressure to the pump 16, entering port B. Port B transmits the pressure through passage G to chamber IH in the combined control, to removable orifice 7, and control 13 poppet 9. As soon as any positive pressure is exerted on chamber IH, the combined control poppet 1 closes, stopping flow from passage E to passage F across the combined control. This means that when said combined control has the same or greater pressure exerted on chamber IH in reference to the pressure exerted in passage E, said combined control poppet 1 goes to the closed position. This occurs because of the aforementioned area ratio difference that requires two times the force in regard to the pressure in passage E as opposed to the pressure in chamber IH. As the combined control poppet 1 closes, the combined control spool 32 begins to open passage E to passage F modulating the flow and bypassing only enough fluid to maintain a prescribed pressure drop. As combined control poppet 1 closes, the pressure in passage E and chamber IH continues to increase causing the combined control spool 32 to begin to open due to the bias set on said control. This pressure drop is variable for multivalve use and is regulated via screw 5 which controls the set tension on spring 4 in relation to the combined control spool 32. Only said combined control poppet 1 maintains a 2:1 area ratio in reference to passage E and chamber IH as aforementioned. The combined control spool 32 is spring-biased and has an effective area ratio of 1:1 in reference to passage E and chamber IH, causing said combined control spool 32 to be the only truly biased control. As passage G senses load pressure and this pressure is applied to chamber IH of the combined control, the total pressure in passage E would be spring tension plus load pressure.

If the pump output flow, due to downstream restrictions in the piping or the control valve assembly 19, is not sufficient, the spring tension can be increased by adjusting screw 5 on the combined control. Pressure would increase with load until the setting on control 13 was reached.

At a predetermined and adjustable pressure, poppet 9 would lift off seat 10, allowing flow from passage G to chamber J. The high pressure is set by screw 6 changing the tension on spring 8 in control 13. This offsets the balance pressure in chamber IH allowing more flow to passage F from passage E keeping the pressure from exceeding the preset valve in control 13. If the controlled response is too fast, the orifice 7 may be altered in size, causing a control response lag via controlled leakage from passage G to passage K which is interconnected to passage F and the reservoir 17.

When valve 19 returns to the neutral condition, the pump 16 returns to the first mentioned condition.

Figure 4:
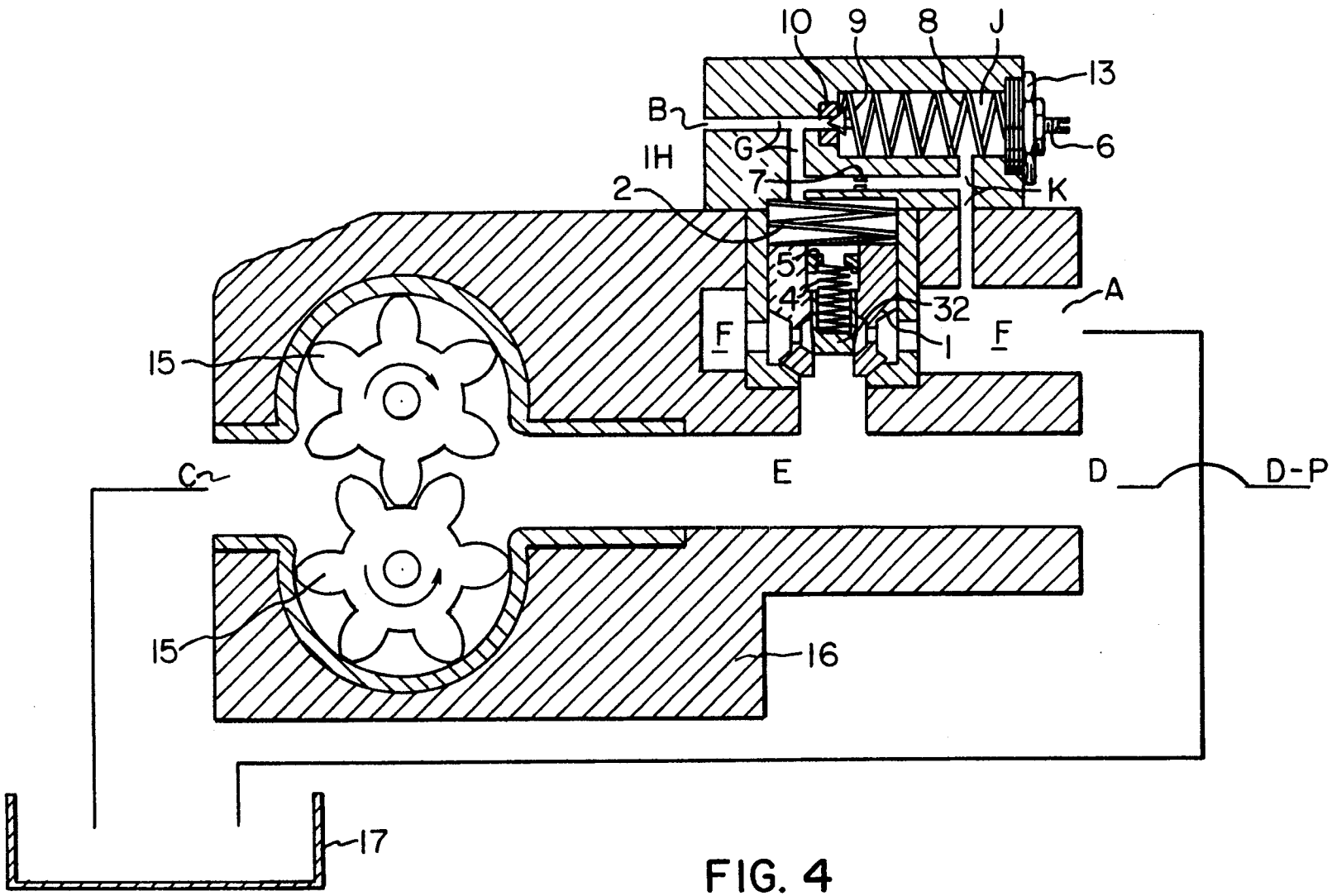
FIG. 4 shows a longitudinal section representation of the combined low unload bypass control with a hydrostat of the poppet design.

The pump in FIG. 4 operates identically to the pump shown in FIG. 3. The only physical difference is that spool 32 in FIG. 3 has been replaced with a poppet 32 in FIG. 4. The hydrostat poppet 32 as previously stated may be of the spool, poppet or plunger design. The spool design hydrostat may, however, give a more finite metering characteristic in modulation than the poppet design.

The combined control illustrated in FIG. 4 functions as previously stated and in reference to the simplified logic chart shown in FIG. 5. The pressure effective areas are designated as A, B, C and D. The said load pressure or lack of load pressure is applied to control areas A and B. The pump gear discharge pressure is applied to areas C and D. The logic chart explains the function of poppet 1 and spool or poppet 32 in reference to pump functions.

The effective area of each of pressure areas A, B, C and D is as follows: A=2.011; B=0.4414; C=0.4414; and D=0.7846. The logic chart in FIG. 5A of the drawings explains the action of poppet 1 and spool 32.

Figure 6:
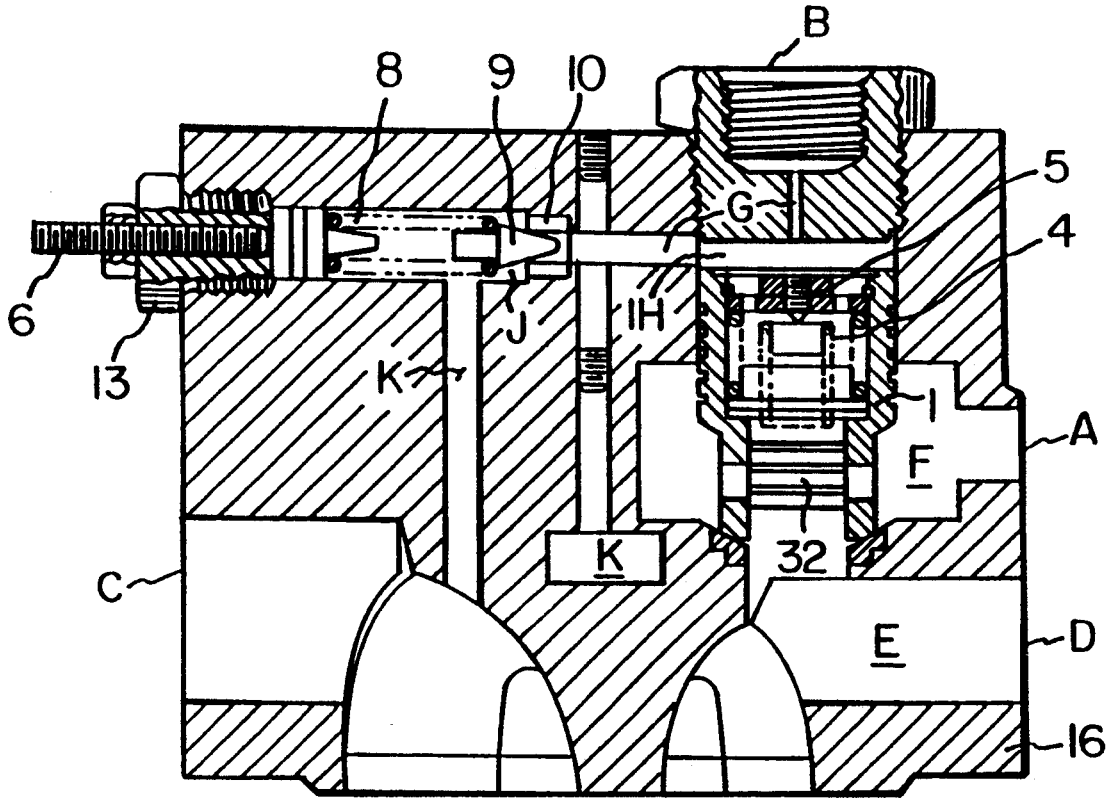
FIG. 6 shows a longitudinal view of the combined low unload bypass control incorporated into the discharge pressure volute of the pump housing and making the control part of said volute structure.

The pump in FIG. 6 in conjunction with the gears 15 shown in FIG. 3 operates as follows: In the neutral condition, the control valve or valves 19, FIG. 2, will be in a P pressure blocked X and Y to reservoir 17, spring center condition. This neutral condition of the pump 16 is shown in FIG. 6 and neutral condition of valve 19 is schematically represented in FIG. 2.

As the gears 15 are turned, hydraulic fluid is directly pulled from the reservoir 17, through port C. The fluid is discharged from gears 15, to passage E and out-port D and through the inlet in-line hydrostat 21 to the pressure blocked port on valve 19, thus deadheading the pressure line. Spring 2, in the combined control consisting of spring 2, adjustment 5, spring 4, poppet 1 and spool 32, will begin to be depressed by the pressure exerted against the area of poppet 1, in reference to passage E. At a low pressure 30 psi or less in passage E, poppet 1 will move enough to connect passage E to passage F the combined control, allowing the fluid to pass out port A to the reservoir 17. Fluid at this time cannot pass from passage E to F through the combined control spool 32 as the spring 4, tension is adjustable in a range of 60 to 300 psi and holding spool 32 in the closed position. At this time all flow produced by the turning of the gears 15 is passing through the combined control to the reservoir 17 at a low pressure drop. As no fluid flow is present past the pressure blocked port in the control valve 19, the pump load sense port B, feels only reservoir pressure in passages G, and in turn chamber IH of the combined control. Poppet 1 in combined control has a 2:1 pressure effective area ratio in regard to chamber IH and passage E. The unbalanced areas allow spring 2 to be of a light rate and be removed if a near atmosphere unload condition is required. This means that the effective area on which pressure can be applied to poppet 1, in said combined control, via passage E, is 50% less than the effective area which pressure can be applied to poppet 1, in said combined control, via chamber IH. If the pressure in chamber IH is reservoir pressure or ZERO, the amount of pressure in passage E required to open passage E to passage F would be equal to the pressure exerted on the area of poppet 1 in said combined control via the pressure in passage E exceeding the amount of pressure exerted on the poppet 1 in said combined control via spring 2.

Referring to FIG. 2, wherein standard parts are illustrated schematically, and which assembly, per se, forms no part of the present invention, valve 19 is a proportional control valve which is pressure compensated by valve 21. Valve 20 is a shuttle valve giving an alternative signal in relation to load activation as an output signal from the load or actuator to the controller or, in this case, the pump 16.

As power is applied to the solenoid 36, valve H is shifted to the right, allowing flow passage P to flow over the compensator valve 21 through valve 19, and to the motor 31. The amount of load is transmitted through the shuttle valve 20 to shuttle valve 23. Shuttle valve 23 transmits the load pressure to the pump 16, entering port B. Port B transmits the pressure through passage C to chamber IH in the combined control, to removable orifice 7, and control 13 poppet 9. As soon as any positive pressure is exerted on chamber IH, the combined control poppet 1 closes, stopping flow from passage E to passage F across the combined control. This means that when said combined control has the same or greater pressure exerted on chamber IH in reference to the pressure exerted in passage E, said combined control poppet 1 goes to the closed position. This occurs because of the aforementioned area ratio difference that requires two times the force in regard to the pressure in passage E as opposed to the pressure in chamber IH. As the combined control poppet 1 closes, the combined control spool 32 begins to open passage E to passage F modulating the flow and bypassing only enough fluid to maintain a prescribed pressure drop. As combined control poppet 1 closes, the pressure in passage E and chamber IH continues to increase causing the combined control spool 32 to begin to open due to the bias set on said control. This pressure drop is variable for multivalve use and is regulated via screw 5 which controls the set tension on spring 4 in relation to the combined control spool 32. Only said combined control poppet 1 maintains a 2:1 area ratio in reference to passage E and chamber IH as aforementioned. The combined control spool 32 is spring-biased and has an effective area ratio of 1:1 in reference to passage E and chamber IH, causing said combined control spool 32 to be the only truly biased control. As passage G senses load pressure and this pressure is applied to chamber IH of the combined control, the total pressure in passage E would be spring tension plus load pressure.

If the pump output flow, due to downstream restrictions in the piping or the control valve assembly 19, is not sufficient, the spring tension can be increased by adjusting screw 5 on the combined control. Pressure would increase with load until the setting on control 13 was reached.

At a predetermined and adjustable pressure, poppet 9 would lift off seat 10 allowing flow from passage G to chamber J. The high pressure is set by screw 6 changing the tension on spring 8 in control 13. This offsets the balance pressure in chamber IH allowing more flow to passage F from passage E keeping the pressure from exceeding the preset valve in control 13. If the controlled response is too fast, the orifice 7 may be altered in size, causing a control response lag via controlled leakage from passage G to passage K which is interconnected to passage F and the reservoir 17.

When valve 19 returns to the neutral condition, the pump 16 returns to the first-mentioned condition.

While I have illustrated and described several embodiments of my invention, it will be understood that these are by way of illustration only and that various changes and modifications may be contemplated in my invention and within the scope of the following claims.

I claim:

1. A load sensed variable output gear pump comprising:

an integral housing;

a constant displacement type fluid delivery pump enclosed within said housing;

a main inlet-outlet passage positioned within said housing and pressured by said pump;

a bypass outlet passage positioned within said housing and connected to a reservoir;

a control controlling the flow through said bypass outlet passage, said control comprising (i) a chamber between said main inlet-outlet passage and said bypass outlet passage, said chamber having an inlet coupled to said main inlet-outlet passage, an outlet coupled to said bypass outlet passage and a load sense opening, (ii) a spring-biased spool positioned within said chamber which has an effective area ratio of 1:1 with reference to said chamber and said main inlet-outlet passage, a spring biasing said spring-biased spool to a closed position and pressure from said main inlet-outlet passage acting on one side of said spool against the force of said spring, (iii) a poppet positioned within said chamber and surrounding said spool, said poppet having an effective area ratio of 2:1 between said main inlet-outlet passage and said chamber wherein said poppet is movable between an open position allowing fluid communication between said chamber inlet and said chamber outlet and a closed position preventing fluid communication between said chamber inlet and said chamber outlet with said spool movable with said poppet, and (iv) a load sense passage coupled to said load sense opening and coupled to load pressure, wherein said poppet is moved to said closed position by pressure from said load sense passage and said poppet is moved to said open position by pressure from said main inlet-outlet passage against said pressure from said load sense passage;

wherein said poppet of said control is normally open when pressure is not applied to said load sense passage, whereby said main inlet-outlet passage is connected to said bypass outlet passage at a low pressure drop, whereby said control is configured for closing and shutting off flow from said bypass outlet passage when positive pressure enters said load sense passage;

wherein said spool is normally closed, thereby allowing said main inlet-outlet passage to be open to said bypass outlet passage when pressure is not applied to said inlet load sense passage.

2. The apparatus as recited in claim 1 including an overload control connected to said load sense passage and which is normally closed, having a variable tension, spring pressed poppet allowing flow from said load sense passage to said bypass outlet passage to occur when said load sense passage reaches a predetermined positive pressure unbalancing said variable control, allowing more flow to said reservoir through said bypass outlet passage, said overload control further including a variable orifice for restricting flow through said load sense passage thereby dampening the response of said variable control and said control and said overload control by creating a response lag due to bypass flow regulated by flow through said variable orifice.

3. A load sensed variable output pump system comprising:

a fixed displacement pump; and a load sensing control comprising a housing having a main inlet-outlet passage pressured by said pump, a bypass outlet passage connected to a reservoir, a control controlling the flow through said bypass outlet passage, said control comprising (i) a chamber between said main inlet-outlet passage and said bypass outlet passage, said chamber having an inlet coupled to said main inlet-outlet passage, an outlet coupled to said bypass outlet passage and a load sense opening, (ii) a spring-biased spool positioned within said chamber which has an effective area ratio of 1:1 with reference to said chamber and said main inlet-outlet passage, a spring biasing said spring-biased spool to a closed position and pressure from said main inlet-outlet passage acting on one side of said spool against the force of said spring, (iii) a poppet positioned within said chamber and surrounding said spool, said poppet having an effective area ratio of 2:1 between said main inlet-outlet passage and said chamber wherein said poppet is movable between an open position allowing fluid communication between said chamber inlet and said chamber outlet and a closed position preventing fluid communication between said chamber inlet and said chamber outlet with said spool movable with said poppet, and (iv) a load sense passage coupled to said load sense opening and coupled to load pressure, wherein said poppet is moved to said closed position by pressure from said load sense passage and said poppet is moved to said open position by pressure from said main inlet-outlet passage against said pressure from said load sense passage;

wherein said poppet of said control is normally open when pressure is not applied to said load sense passage, whereby said main inlet-outlet passage is connected to said bypass outlet passage at a low pressure drop, whereby said control is configured for closing and shutting off flow from said bypass outlet passage when positive pressure enters said load sense passage;

wherein said spool is normally closed, thereby allowing said main inlet-outlet passage to be open to said bypass outlet passage when pressure is not applied to said inlet load sense passage.

* * * * *